US009046009B2

(12) United States Patent
Ross et al.

(10) Patent No.: US 9,046,009 B2
(45) Date of Patent: Jun. 2, 2015

(54) TAPPET FOR A VALVE TRAIN OR A PUMP DRIVE AND METHOD OF MAKING A TAPPET

(71) Applicant: Schaeffler Technologies AG & Co. KG, Herzogenaurach (DE)

(72) Inventors: Christoph Ross, Stegaurach (DE); Alexander Backer, Grafenberg (DE); Josef Groschel, Gossweinstein (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 13/903,035

(22) Filed: May 28, 2013

(65) Prior Publication Data

US 2013/0319364 A1 Dec. 5, 2013

(30) Foreign Application Priority Data

May 31, 2012 (DE) ..... 10 2012 209 186

(51) Int. Cl.

| | |
|---|---|
| ***F01L 3/02*** | (2006.01) |
| ***F01L 3/20*** | (2006.01) |
| ***F01L 1/14*** | (2006.01) |
| ***F01L 1/25*** | (2006.01) |
| *F02M 59/10* | (2006.01) |
| *F02M 59/48* | (2006.01) |

(52) U.S. Cl.

CPC ..... *F01L 3/20* (2013.01); *F02M 59/102* (2013.01); *F01L 1/143* (2013.01); *F01L 1/25* (2013.01); *F01L 2107/00* (2013.01); *F02M 59/48* (2013.01); *F02M 2200/8084* (2013.01)

(58) Field of Classification Search

CPC ..... F01L 2107/00; F01L 1/14; F02M 59/102
USPC ..... 123/90.5, 90.48, 188.3
See application file for complete search history.

(56) References Cited

U.S. PATENT DOCUMENTS

| | | | | |
|---|---|---|---|---|
| 2,729,306 | A * | 1/1956 | Davis | 184/6.9 |
| 4,275,555 | A * | 6/1981 | Bichi | 59/3 |
| 4,771,741 | A * | 9/1988 | Leer | 123/90.5 |
| 4,790,473 | A * | 12/1988 | Narasimhan et al. | 228/206 |
| 5,201,532 | A * | 4/1993 | Salesky et al. | 277/530 |
| 5,975,038 | A * | 11/1999 | Fischer et al. | 123/90.55 |
| 7,210,437 | B2 * | 5/2007 | Geyer | 123/90.5 |
| 7,210,438 | B2 * | 5/2007 | Canino et al. | 123/90.55 |

(Continued)

FOREIGN PATENT DOCUMENTS

DE 102004036106 3/2006

*Primary Examiner* — Lindsay Low
*Assistant Examiner* — Long T Tran
(74) *Attorney, Agent, or Firm* — Volpe and Koenig, P.C.

(57) ABSTRACT

A tappet for a valve train or a pump drive particularly a cup tappet (1) having a hollow cylindrical outer body on whose wall region (4) an anti-rotation element (9) is received in a window-type through-opening (15), the anti-rotation element (9) being seated through support surfaces (12, 13) of a head (10) on an outer diameter (14) of the wall region (4) and extending with a shank (11) projecting from the head (10) through said through-opening (15). The anti-rotation element (9) is fixed via a welded joint. In order to fix the anti-rotation element (9) with low manufacturing costs and, at the same time, with only an insignificant impairment of the outer body, the welded joint is made between the shank of the anti-rotation element (9) and an inner body that is received in the outer body and is connected to the outer body. A method of making a tappet of the aforesaid tappet is also provided.

10 Claims, 3 Drawing Sheets

(56) References Cited

U.S. PATENT DOCUMENTS 7,464,680 B2 * 12/2008 Geyer et al. ..... 123/90.59
8,201,532 B2 * 6/2012 Prokop ..... 123/90.5
8,235,018 B2 * 8/2012 Dorn et al. ..... 123/90.48
2009/0217896 A1 * 9/2009 Schnell et al. ..... 123/90.51
2011/0259142 A1 * 10/2011 Copper et al. ..... 74/569

* cited by examiner

TAPPET FOR A VALVE TRAIN OR A PUMP DRIVE AND METHOD OF MAKING A TAPPET

INCORPORATION BY REFERENCE

The following documents are incorporated herein by reference as if fully set forth: German Patent Application No. DE 102012209186.6, filed May 31, 2012.

FIELD OF THE INVENTION

The invention concerns a tappet for a valve train or a pump drive particularly a cup tappet comprising a hollow cylindrical outer body on whose wall region an anti-rotation element is received in a window-type through-opening, said anti-rotation element being seated through support surfaces of a head on an outer diameter of said wall region and extending with a shank projecting from said head through said through-opening, and said anti-rotation element being fixed with help of a welded joint. The invention further concerns a method of making a tappet of the aforesaid type.

BACKGROUND

Tappets are used in valve trains and pump drives for converting in cooperation with at least one cam of a camshaft or with a pump drive shaft, a rotational movement of said shaft into a translational movement of a valve or of a pump piston. In the case of a valve train of an internal combustion engine with a bottom camshaft, the tappet is further in contact through a tappet pushrod and a rocker arm with an associated gas exchange valve, while in the case of an overhead camshaft, a tappet mostly configured as a cup tappet, is disposed directly between cam and gas exchange valve. In the case of a pump drive, too, the tappet is likewise usually arranged directly between a cam of the pump drive shaft and the respective pump piston.

In addition, for reducing friction, frequently, either a vaulted running surface is configured on an outer body of the tappet, or the outer body comprises a running roller that is mounted for rotation on the outer body and runs along the cam of the camshaft or on the pump drive shaft. In order to assure a permanent correct orientation of the running surface or running roller relative to the respective cam and thus also to prevent an undesired rotation of the tappet, the tappet is usually provided with an anti-rotation element through which the tappet is fixed in peripheral direction and runs along a lift axis in a guide of a surrounding component, for instance the cylinder head of the internal combustion engine or in a pump housing. Frequently, this anti-rotation element is pressed into a corresponding through-opening on a wall region of the outer body.

However, the light-weight structure with small wall thicknesses in the wall region as well as heat treatments and coatings lead partially to occurrence of cracks in the region of the through-opening when the anti-rotation element is being pressed into the through-opening. For avoiding such cracks, it is necessary to respect narrow tolerances in making the through-opening and also during the manufacture of the associated anti-rotation element, all this resulting in a corresponding technical complexity and higher expenses. By reason of this fact, an anti-rotation element is sometimes also applied to the outer body by other methods.

DE 10 2004 036 106 A1 discloses a tappet in the form of a cup tappet for a valve train of an internal combustion engine. This tappet comprises a hollow cylindrical outer body on whose front end a counter running surface for a cam of the valve train is configured, while the outer body comprises on a wall region, a window-type through-opening. An anti-rotation element with a mushroom-shaped cross-section is received in this through-opening and is positioned with the region of a head comprising support surfaces on an outer diameter of the wall region, while the anti-rotation element is inserted through the through-opening with a shank starting from the head and is fixed with the shank in the through-opening. One possible method for this fixing proposed by DE 10 2004 036 106 A1 is to weld the shank of the anti-rotation element to the through-opening.

SUMMARY

Departing from the aforesaid prior art, it is an object of the present invention to provide a tappet for a valve train or for a pump drive in which an anti-rotation element can be made with low manufacturing costs and can be fixed at the same time with insignificant impairment of an outer body of the tappet.

With regard to the technical aspects of the device, the objective is met with a tappet having one or more features of the invention. A method of making a tappet of the aforesaid type is also provided utilizing one or more features of the invention. Advantageous developments of the invention are described below and in the claims.

According to the invention, a tappet for a valve train or a pump drive comprises a hollow cylindrical outer body on whose wall region an anti-rotation element is received in a window-type through-opening, said anti-rotation element being seated through support surfaces of a head on an outer diameter of said wall region and extending with a shank projecting from said head through said through-opening. The anti-rotation element is fixed with help of a welded joint. Preferably the hollow cylindrical outer body has a cup-shaped configuration in which a front end running region adjoins the wall region, through which running region the tappet is in contact with at least one cam of a valve camshaft or of a pump drive shaft in the installed state. A running roller can be received on this running region to run along the at least one cam while being mounted for rotation on rolling bearings on the front end of the outer body so that a rotational movement of the camshaft or of the pump drive shaft can be converted with low friction into a translational displacement of the tappet. Alternatively, however, the front end running region may also be configured with a cylindrical counter running surface, i.e. with a vaulted contact surface on which the at least one cam rolls.

Further, the anti-rotation element can particularly be configured as a component with an elongate geometry in lift direction of the tappet, which anti-rotation element extends with the head in a longitudinal groove of a complementary shape made in a surrounding structure such as a cylinder head of the internal combustion engine, or a pump housing. The shank of the anti-rotation element further particularly comprises a rectangular geometry to which the window-type through-opening likewise has a complementary shape, i.e. a rectangular geometry. Irrespective of this, other cross-section are also imaginable, such as, for instance, triangular, polygonal or rounded geometries.

The invention provides the technical teaching that the welded joint is made between the shank of the anti-rotation element and an inner body that is received in the outer body and is connected to the outer body. In other words, the anti-rotation element is welded on its shank to an inner body that is positioned in an inner space defined by the hollow cylindrical outer body. In this way, on the one hand, it is possible to omit a pressing-in of the anti-rotation element into the window-type through-opening so that cracks on the through-opening can be avoided and narrow tolerances in the manufacturing of the through-opening and the anti-rotation element are no longer necessary. On the other hand, the anti-rotation element is reliably fixed in the desired position and, in addition, due to the welding to the internally situated inner body, an input of thermal energy into the outer body and a concomitant deformation of the outer body during welding can be substantially avoided. Thus, on the whole, an anti-rotation device of the tappet can be realized with low manufacturing costs and only insignificant impairment of the outer body and, further, the fixing of the anti-rotation element can be integrated in a simple manner in the existing series steps.

The tappet of the invention is made particularly in that, at first, the anti-rotation element together with the shank is placed in the through-opening of the outer body. In a next step, the anti-rotation element is oriented relative to the outer body in peripheral direction, following which the shank of the anti-rotation element is welded to the inner body. By reason of the orientation and the subsequent welding of the two components to each other, the anti-rotation element is fixed with an orientation in lift direction of the tappet so that an otherwise necessary orientation via the through-opening in the outer body can be omitted. As a consequence, both the through-opening in the outer body and the shank of the anti-rotation element can be made with rougher tolerances, the shank of the anti-rotation element being inserted through the through-opening with a loose fit, i.e. with lash in axial as well as in peripheral direction.

According to a further advantageous form of embodiment of the invention, one front surface of the shank is welded to an opposing support surface on the inner body. For this purpose, the anti-rotation element is pressed with the front end of the shank against the support surface with help of an outer pair of welding pliers, and subsequently, the anti-rotation device and the inner body are resistance welded to each other between the outer pair of welding pliers and an inner pair of welding pliers. Thus, advantageously, the anti-rotation element and the inner body can be connected to each other by a simple and well controllable manufacturing method. In addition, a welding of the two components to each other by resistance welding can be integrated in a simple manner in an existing series method. Moreover, a welding of the two components to each other with the two pairs of welding pliers can be performed without any problem in that the outer pair of welding pliers is brought into contact with the head of the anti-rotation element whereas the inner pair of welding pliers is applied from radially inside to the inner side of the inner body at the seating level of the shank of the anti-rotation element on the inner body. Through a high current flow between the two pairs of welding pliers and the pressing-together of the two components, the shank and the inner body melt at the joining point due to the flowing electric current and get connected through a fusion of material.

In a further development of the invention, the orienting of the anti-rotation element relative to the outer body is performed through a guide surface of the outer pair of welding pliers. In other words, the outer pair of welding pliers comprises on a side facing the head of the anti-rotation element a correspondingly shaped surface through which the anti-rotation element is oriented relative to the outer body in peripheral direction. Thus, if the head has a rectangular cross-section, this guide surface can be configured as a straight guide surface, whereas, in the case of a head with a rounded cross-section, the outer pair of welding pliers also comprises a corresponding, rounded surface which, for this purpose, must particularly have a slighter vaulting than the head of the anti-rotation element. Therefore, in both cases, a correct orientation of the anti-rotation element in the through-opening of the outer body is guaranteed prior to welding through the corresponding configuration of the guide surface matched to the head of the anti-rotation element.

According to a further advantageous form of embodiment of the invention, the anti-rotation element is pressed with the front end of the shank with help of the outer pair of welding pliers onto a radially outwards protruding elevation of the inner body, said elevation is melted off the anti-rotation element and the inner body during the resistance welding with formation of the support surface, and during the melting-off, the anti-rotation element is pressed with its head till the anti-rotation element comes to a stop against the outer diameter of the outer body. Thus, the welding of the anti-rotation element and the inner body to each other is performed in the manner of resistance projection welding in which the projection in form of the elevation is melted off and as a result, the welded joint is formed between the anti-rotation element and the inner body. This radial elevation is preferably configured to correspond to a welding electrode of the inner pair of welding pliers so that after the elevation is the melted off, resistance no longer exists.

In a further development of the invention, the anti-rotation element projects with the shank radially into a depression on the inner body that overlaps the through-opening in peripheral direction, in the bottom region of which depression the support surface is configured. In this way, a relative position of the inner body to the anti-rotation element and also the outer body is defined by the depression provided on the inner body.

According to the invention, the outer body is a cup in which a funnel constituting the inner body is inserted, said funnel together with the cup defining an intermediate oil chamber. Thus, in this case, the tappet of the invention is configured as a cup tappet in which a hydraulic lash adjusting device can be supplied with the necessary oil via the intermediate chamber. Alternatively, the tappet of the invention may also be a roller tappet which likewise comprises a hydraulic lash adjustment.

According to one example of embodiment of the invention, the anti-rotation element comprises an overall mushroom-shaped cross-section. This means that an anti-rotation element is configured with a head and a shank with which, on the one hand, by reason of the head an undesired migration through the through-opening is excluded and which, on the other hand, assures a reliable guidance of the tappet in a surrounding component and has compact dimensions.

The invention is not limited to the given combination of the independent claims or of the dependent claims. Much rather, there are many possibilities of combining individual features, as far as they result from the claims, the following description of an example of embodiment or from the figures. Reference made to the drawings in the claims by the use of reference numerals is not intended to limit the scope of protection of the claims.

BRIEF DESCRIPTION OF THE DRAWINGS

Preferred forms of embodiment of the invention will be described more closely in the following with reference to the appended drawings.

DETAILED DESCRIPTION OF THE PREFERRED EMBODIMENTS

Figure 1:
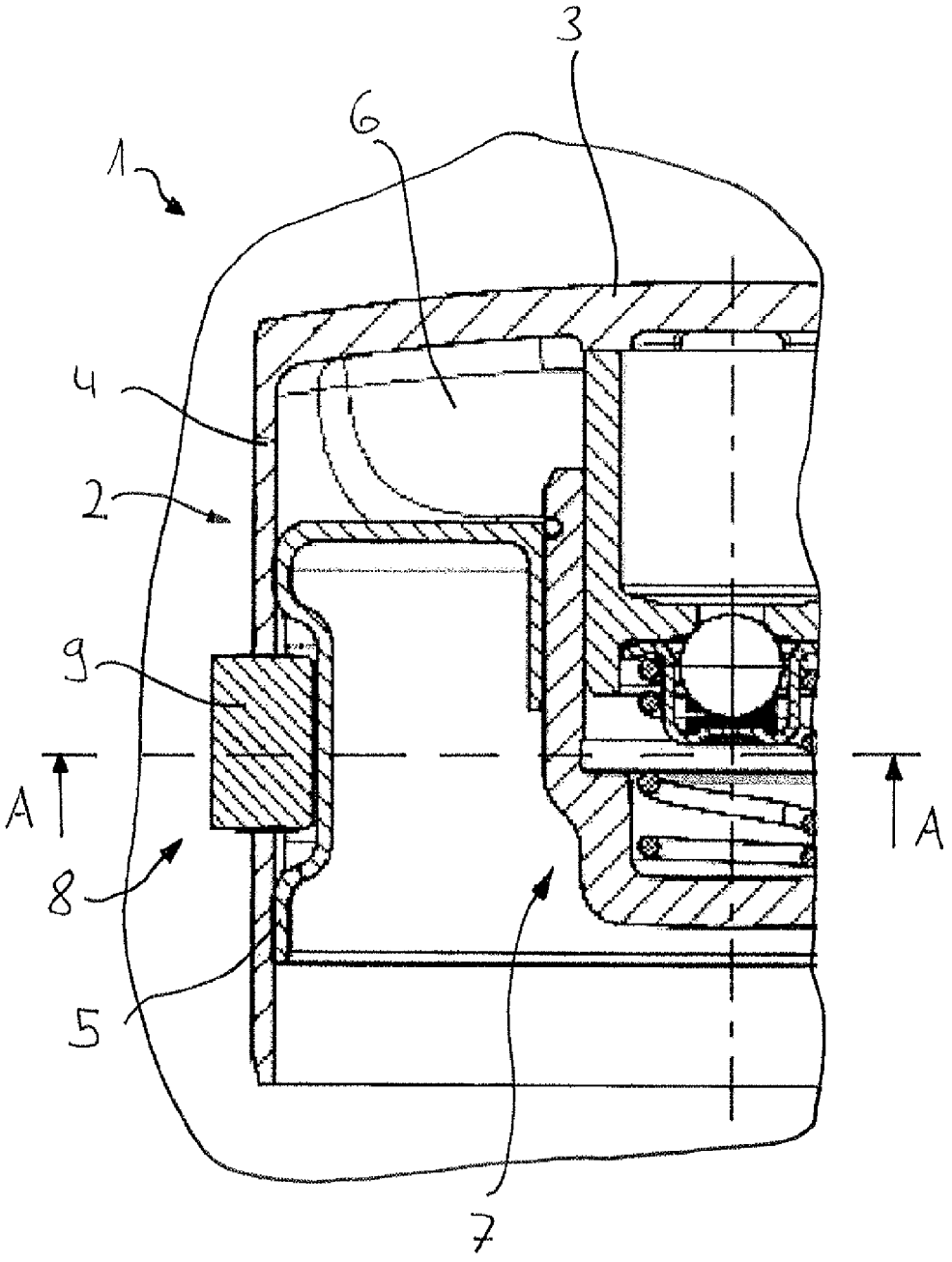
FIG. 1 shows a sectional view of a tappet of the invention according to one preferred form of embodiment of the invention, taken in the region of an anti-rotation element.

FIG. 1 shows a sectional view of a tappet of the invention according to one preferred form of embodiment of the invention. This tappet is configured as a cup tappet 1 comprising a hollow cylindrical outer body in form of a cup 2 that is composed of a front end running region 3 comprising a cylindrical running surface and a wall region 4. Further, an inner body in form of a funnel 5 is received in the hollow cylinder defined by the wall region 4 and the running region 3, said funnel 5 being connected rotationally fast to the cup 2, for example, through a circumferential weld seam between the funnel 5 and the wall region 4. In the present case, the funnel 5 defines together with the cup 2 an intermediate oil chamber 6 of a hydraulic lash adjusting device 7 whose exact structure is known to a person skilled in the art and which will therefore not be described more closely in the following.

In the installed state, the cup tappet 1 is a part of a valve train and is in contact through the running surface of the running region 3 with at least one cam of a valve camshaft, a rotational movement of the camshaft being convertible into a corresponding lift movement of the cup tappet by the at least one cam of this camshaft, which lift movement is transmitted via the intermediate hydraulic lash adjusting device 7 to an associated gas exchange valve. During its displacement, the cup tappet 1 is guided in a surrounding component particularly a cylinder head of the respective internal combustion engine. Because the cylindrical running surface of the running region 3 must not be rotated relative to the at least one cam in peripheral direction, the cup tappet 1 comprises an anti-rotation feature 8 in form of an anti-rotation element 9 through which, in cooperation with a correspondingly configured groove oriented in lift direction, the cup tappet 1 is prevented from rotating in a peripheral direction.

Figure 2:
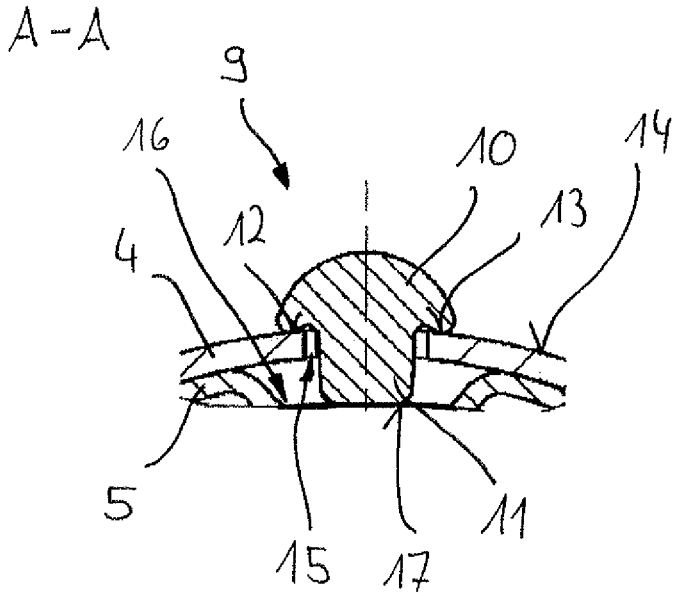
FIG. 2 shows a further sectional view, taken along line A-A of FIG. 1.

As viewed in combination with the further sectional view shown in FIG. 2, it is clear that the anti-rotation element 9 has a mushroom-shaped cross-section that is composed of a head 10 and an adjoining shank 11. Support surfaces 12 and 13 of the anti-rotation element 9 rest on an outer diameter 14 of the wall region 4, while the shank 11 extends in direction of the funnel 5 through a window-type through-opening 15 configured in the wall region. The shank 11 is inserted with a loose fit through the through-opening 15 and protrudes into a depression 16 on the funnel 5, which projection overlaps the through-opening 15 in peripheral direction, a support surface 17 for the shank 11 being configured in a bottom region of the depression 16. With this support surface 17, the shank 11 is welded at its front end so that, in combination with the seating of the head 10 on the outer diameter 14, the anti-rotation element 9 is retained on the wall region 4 and on the funnel 5. In the installed state of the cup tappet 1, the anti-rotation element 9 is in contact with the surrounding groove through ends of the head 10 that are oriented in peripheral direction.

Figure 4:
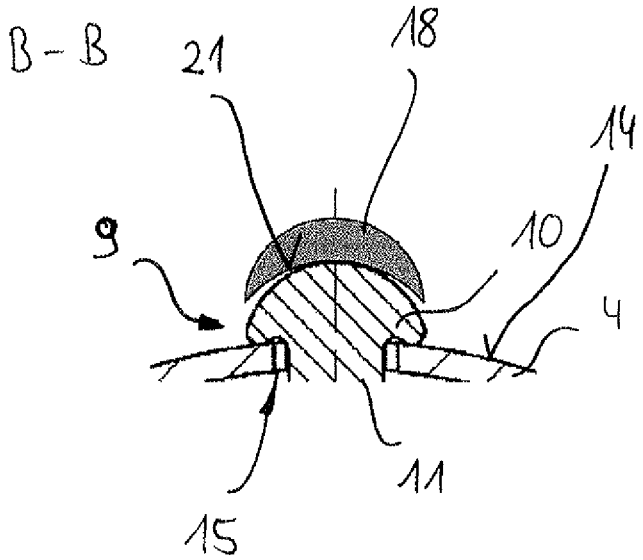
FIG. 4 shows another sectional view, taken along line B-B of FIG. 3.
Figure 3:
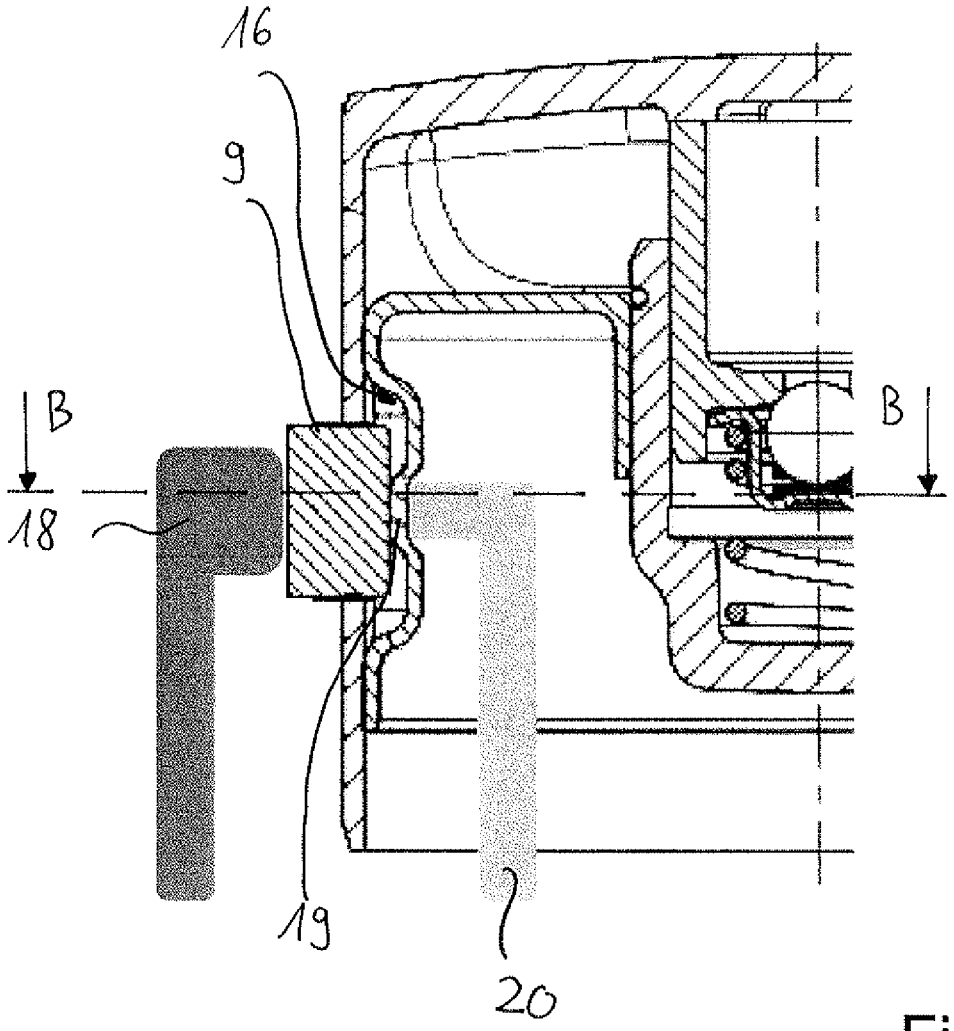
FIG. 3 shows a still further sectional view of the tappet of FIG. 1, directly before welding of an anti-rotation element to an inner body of the tappet.

In the present case, the welded joint between the funnel 5 and the anti-rotation element 9 is made by resistance projection welding. The exact method of making the cup tappet 1 will now be described with reference to the further FIGS. 3 and 4: at first, the anti-rotation element 9 is placed with its shank 11 in the through-opening 15 of the cup 2, the cup 2, the funnel 5 and the hydraulic lash adjusting device 7 having already been assembled before this step. For this purpose, the anti-rotation element 9 is pressed by an outer pair of welding pliers 18 against a radially outwards protruding elevation 19 of the depression 16, counter retention in a backward region of this elevation 19 being achieved through an inner pair of welding pliers 20. As can be seen in FIG. 4, the outer pair of welding pliers 18 comprises a guide surface 21 facing the head 10 of the anti-rotation element 9, said guide surface 21 having a curved configuration. The curvature of this guide surface 21 is weaker than the curvature of the head 10 so that, during the positioning of the anti-rotation element 9 in the through-opening 15, the anti-rotation element 9 is oriented in peripheral direction, i.e. a slanting position of the anti-rotation element 9 in the through-opening 15 is prevented.

Following this, a high electric current is conducted by the welding pliers 18 and 20 through the anti-rotation element 9 and the elevation 19 of the funnel 5 so that the elevation 19 is melted off and a joint is formed by fusion of materials between the shank 11 of the anti-rotation element 9 and the funnel 5. During melting-off, the anti-rotation element 9 is pressed by the outer pair of welding pliers 18 till it comes to rest against the outer diameter 14 of the wall region 4.

Through the inventive configuration of a tappet as also through the inventive method of making a tappet of the invention, it becomes possible to configure an anti-rotation feature 8 with low costs of manufacturing. Further, an impairment of an outer body through thermal energy used in the welding step is substantially avoided. In addition, the manufacturing of this anti-rotation feature by resistance welding can be integrated into existing series steps without any problem.

LIST OF REFERENCE NUMERALS

1 Cup tappet
2 Cup
3 Running region
4 Wall region
5 Funnel
6 Oil chamber
7 Hydraulic lash adjusting device
8 Anti-rotation feature
9 Anti-rotation element
10 Head
11 Shank
12 Support surface
13 Support surface
14 Outer diameter
15 Through-opening
16 Depression
17 Support surface
18 Outer pair of welding pliers
19 Elevation
20 Inner pair of welding pliers
21 Guide surface

The invention claimed is:

1. A tappet for a valve train or a pump drive, comprising a hollow cylindrical outer body having a wall region with a window-type through-opening in which an anti-rotation element is received, said anti-rotation element is seated by support surfaces of a head thereof on an outer diameter of said wall region and extends with a shank projecting from said head through said through-opening, and said anti-rotation element being fixed in position by a welded joint, the welded joint is made between the shank of the anti-rotation element and an inner body that is separate from the outer body, received in the outer body, and connected to the outer body.

2. The tappet according to claim 1, wherein the shank of the anti-rotation element is received through the through-opening with a loose fit.

3. The tappet according to claim 1, wherein a front end surface of the shank is welded to an opposing support surface on the inner body.

4. The tappet according to claim 3, wherein the anti-rotation element projects with the shank radially into a depression on the inner body, said depression overlaps the through-opening in a peripheral direction, and the support surface is provided in a bottom region of said depression.

5. The tappet according to claim 1, wherein the outer body is a cup in which a funnel which forms the inner body is inserted, said funnel together with the cup defining an intermediate oil chamber.

6. The tappet according to claim 1, wherein the anti-rotation element has a mushroom-shaped cross-section.

7. A method of making a tappet, comprising following manufacturing steps:

placing an anti-rotation element with a shank thereof in a through-opening of an outer body of the tappet;

orienting the anti-rotation element relative to the outer body in a peripheral direction; and welding the shank of the anti-rotation element to an inner body that is separate from the outer body, received in the outer body, and connected to the outer body.

8. The method according to claim 7, wherein the anti-rotation element is pressed via an outer pair of welding pliers with a front end of the shank against a support surface on the inner body, and the anti-rotation element and the inner body are situated between the outer pair of welding pliers and an inner pair of welding pliers and are resistance welded to each other.

9. The method according to claim 8, wherein an orientation of the anti-rotation element relative to the outer body is provided via a guide surface configured on the outer pair of welding pliers.

10. The method according to claim 8, wherein the anti-rotation element is pressed with the front end of the shank onto a radially outwards protruding elevation of the inner body, said elevation is melted off the anti-rotation element and the inner body during the resistance welding, and during the melting-off, the anti-rotation element is pressed via a head thereof until the anti-rotation element comes to a stop on the outer diameter of the outer body.

* * * * *